US006604789B1

(12) United States Patent
Downing

(10) Patent No.: US 6,604,789 B1
(45) **Date of Patent: *Aug. 12, 2003**

(54) CUSHIONING AND PROTECTION APPARATUS FOR A CHAIR ARMREST

(76) Inventor: David Downing, 125 W. 400 North, Lindon, UT (US) 84042

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/996,360

(22) Filed: Dec. 22, 1997

Related U.S. Application Data

(63) Continuation of application No. 08/724,934, filed on Oct. 2, 1996, now Pat. No. 5,700,053, which is a continuation of application No. 08/330,295, filed on Oct. 27, 1994, now abandoned.

(51) Int. Cl.[7] ..... A47C 31/00

(52) U.S. Cl. ..... 297/227; 297/411.23; 297/411.46; 5/663; 40/320

(58) Field of Search ..... 297/227, 411.23, 297/219.1, 397, 391, 411.46; 5/663, 424; 248/345.1; 40/320, 308

(56) References Cited

U.S. PATENT DOCUMENTS

| | | | | | |
|---|---|---|---|---|---|
| 1,471,716 | A | | 10/1923 | Austin | |
| 1,763,024 | A | | 6/1930 | Underhill et al. | |
| 1,804,841 | A | * | 5/1931 | Pedroli | 248/345.1 |
| 2,057,551 | A | | 10/1936 | Bishop | 297/227 |
| 2,687,589 | A | * | 8/1954 | Brockway | 40/308 |
| 2,918,741 | A | * | 12/1959 | Welter et al. | 40/308 |
| 3,270,454 | A | * | 9/1966 | Lachance | 40/308 |
| 3,281,978 | A | * | 11/1966 | Drugan et al. | 40/308 |
| 3,884,495 | A | * | 5/1975 | Petock | 248/345.1 X |
| 4,089,497 | A | | 5/1978 | Miller et al. | 248/345.1 |
| 4,109,887 | A | * | 8/1978 | Wakeland, Jr. | 5/663 X |
| 4,214,326 | A | * | 7/1980 | Spann | 5/424 X |
| 4,285,544 | A | * | 8/1981 | Zapf | 297/227 X |
| 4,513,983 | A | * | 4/1985 | Calder | 40/308 X |
| 4,554,039 | A | | 11/1985 | James | 3/663 X |
| 4,575,152 | A | * | 3/1986 | McLaughin, Sr. | 297/411.46 |
| 4,588,224 | A | | 5/1986 | Hill, Jr. | 297/DIG. 6 X |
| 4,640,033 | A | * | 2/1987 | Bulger | 40/320 X |
| 4,683,609 | A | * | 8/1987 | Trubiano | 40/308 X |
| 4,767,419 | A | * | 8/1988 | Fattore | 5/663 X |
| 4,925,241 | A | * | 5/1990 | Geraci | 297/219.1 X |
| 4,930,795 | A | * | 6/1990 | Tannehill et al. | 40/308 X |
| 4,969,683 | A | | 11/1990 | Wallace et al. | 297/219.1 X |
| 5,048,892 | A | * | 9/1991 | Ledbetter | 5/663 X |
| 5,175,897 | A | | 1/1993 | Marra, Jr. | 5/663 X |
| 5,331,696 | A | * | 7/1994 | Armstrong | 5/663 X |

(List continued on next page.)

FOREIGN PATENT DOCUMENTS

| | | | |
|---|---|---|---|
| DE | 858508 | 12/1957 | 297/220 |
| DE | 1920529 | 10/1970 | 297/219.1 |
| FR | 1267603 | 9/1960 | 297/219.1 |
| GB | 1316564 | 5/1973 | 297/219.1 |
| GB | 2095544 | * 10/1982 | 297/16.1 |

*Primary Examiner*—Rodney B. White
(74) *Attorney, Agent, or Firm*—Holland & Hart

(57) ABSTRACT

A cushioning and protection apparatus for a chair armrest includes a cushion body having a central cavity and an opening leading thereto. The opening is defined by a pair of jaw projections that are resiliently deformable to enlarge the opening to enable an armrest to be inserted into the central cavity. An attachment device secures the cushioning and protection device to the armrest. The device can easily be installed on and removed from a chair armrest with little effort. The cushioning apparatus is lightweight, easily transportable, and particularly suitable for use in outdoor seating environments.

21 Claims, 2 Drawing Sheets

U.S. PATENT DOCUMENTS 5,332,288 A * 7/1994 Coates ..... 297/227 X
5,360,360 A 11/1994 Peterson ..... 441/130
5,397,162 A * 3/1995 Huang ..... 40/320 X
5,429,416 A * 7/1995 Lofy ..... 297/411.23
5,437,071 A * 8/1995 Feigenbaum ..... 5/663
5,445,433 A * 8/1995 Avihod ..... 297/DIG. 6 X
5,478,137 A 12/1995 Olson et al. ..... 297/411.46 X
5,605,374 A * 2/1997 Perry ..... 297/411.23 X
5,700,053 A * 12/1997 Downing ..... 297/227
5,829,832 A * 11/1998 Molee et al. ..... 297/391 X
5,904,406 A * 5/1999 Stewart ..... 297/397

* cited by examiner

CUSHIONING AND PROTECTION APPARATUS FOR A CHAIR ARMREST

CONTINUITY

This is a continuation of U.S. Continuation patent application Ser. No. 08/724,934, now U.S. Pat. No. 5,700,053 filed Oct. 2, 1996, which is a continuation of U.S. patent application Ser. No. 08/330,295, filed Oct. 27, 1994, now abandoned.

TECHNICAL FIELD

This invention relates to cushioning devices for chairs, and more particularly, to cushioning and protection devices for chair armrests.

BACKGROUND OF THE INVENTION

Devices for protecting and cushioning portions of chairs, such as chair seats, back rests, and armrests, have long been recognized. Various types of paddings and cushions have been attached to chairs to provide comfort and protection to persons seated in the chairs.

Chair pads and cushions are most commonly installed on indoor chairs, rather than outdoor chairs, because indoor chairs are protected from the environment. Significant problems are encountered when installing padding and cushioning on chairs intended for outdoor use. Adverse weather conditions, such as extreme heat, cold, sunlight, and moisture, serve to destroy such cushioning and padding devices in a short period of time.

A particularly significant problem is presented by permanently constructed outdoor seating for places such as outdoor sports stadiums and the like. Chairs for such stadiums must be solidly constructed to withstand the various types of punishment and hard use caused by people sitting in the chairs. Such outdoor seating must also be permanently mounted inside the arena and therefore must be designed to withstand all ranges of temperatures and all weather conditions, from freezing temperatures in the winter to extreme heat and sunlight in the summer. Accordingly, mounting permanent padding or cushions to outdoor seats is impractical because the padding will break down and be destroyed over time under adverse weather conditions.

One particular problem associated with the above-described outdoor chairs is that portions of the chairs, including the seat, backrest, and armrests, become extremely hot from exposure to the sun during the summertime. A person's shirt and pants may protect portions of the person's body from a hot seat and backrest. With respect to the armrests, however, the person sitting in the chair will most likely be wearing a short sleeve shirt. Thus, there is a significant risk that the person's arms will directly contact the sun-heated armrests.

BRIEF SUMMARY AND OBJECTS OF THE PRESENT INVENTION

It is a primary object of the present invention to provide a cushioning and protection apparatus for a chair armrest.

Another object of the present invention is to provide a portable cushioning and protection apparatus for a chair armrest.

Still another object of the present invention is to provide a cushioning and protection apparatus for a chair armrest that can easily be installed on and removed from the chair armrest.

Yet another object of the present invention is to provide a portable cushioning and protection apparatus that is lightweight.

Another object of the present invention is to provide a cushioning and protection apparatus for a chair armrest that is portable, installable on, and removable from a chair armrest in an outdoor arena.

Another object of the invention is to provide a cushioning and protection apparatus that includes a replaceable cover.

Still another object of the present invention is to provide a cushioning and protection apparatus for a chair armrest that thermally insulates the arm of a person sitting in the chair from the armrest structure.

Another object of the invention is to provide a cushioning and protection apparatus for a chair armrest that is installable on and removable from a chair armrest without the need of any tools or technical training.

A further object of the invention is to provide a cushioning and protection apparatus for a chair armrest that forms around and secures itself to the chair armrest.

The foregoing objects are achieved by a cushioning and protection apparatus for a chair armrest including a cushion body having a central cavity and an opening for accessing to the central cavity. The central cavity is sized to receive a portion of a chair armrest. The cushion body is made of a resilient, deformable material. The opening can be enlarged by resiliently deforming the material for insertion of the chair armrest into the central cavity. Thereafter, the memory of the resilient material causes the material to close around the chair armrest to hold the protection and cushioning apparatus in place about the armrest. A removable cover may be placed over the resilient material. The cover may include indicia, such as a team name, logo, or the like.

Other objects, features, and advantages of the application will become more apparent from the following detailed description of the invention with reference to the accompanying drawings.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 2:
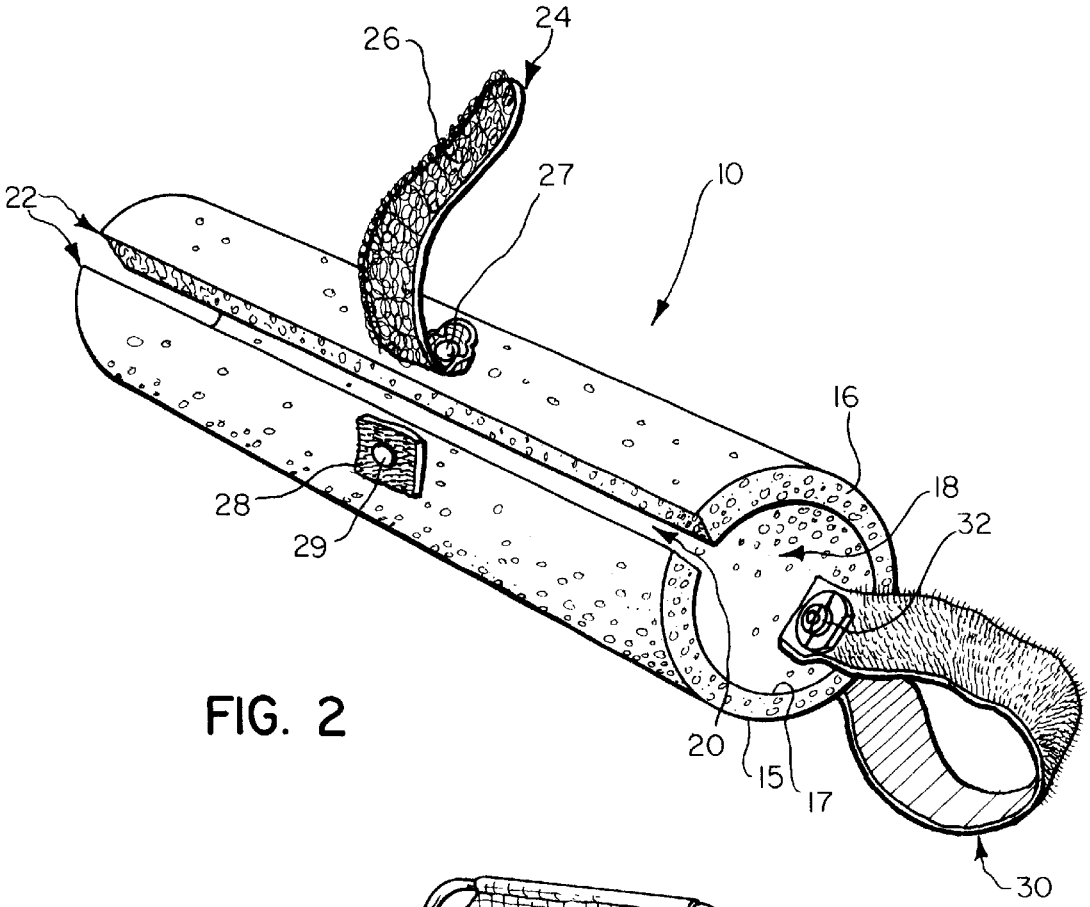
FIG. 2 is an enlarged isometric view of one cushioning and protection apparatus shown in FIG. 1.
Figure 1:
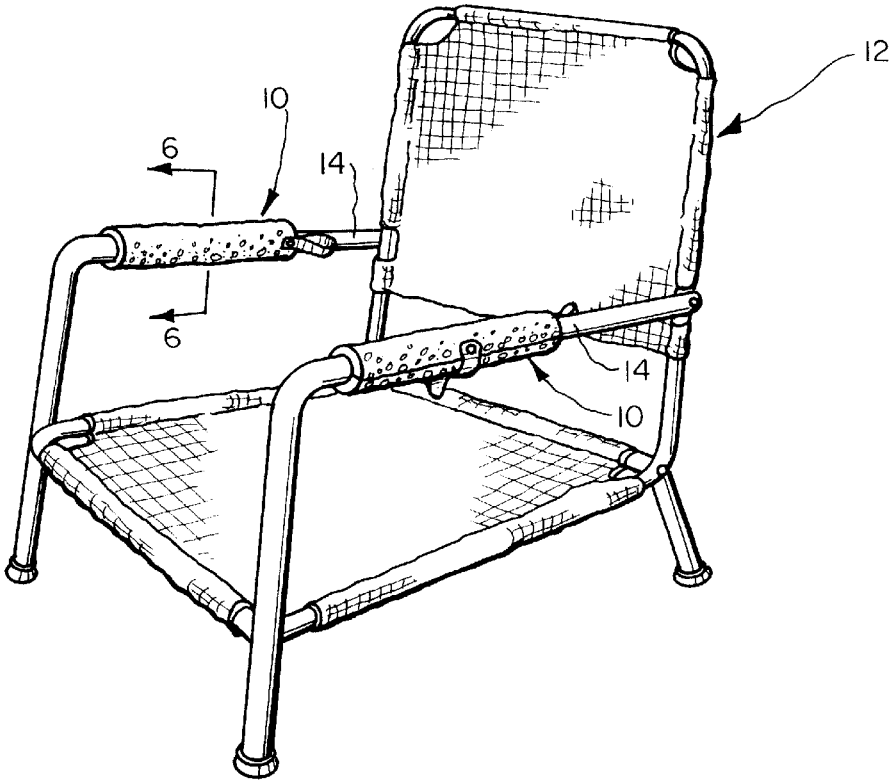
FIG. 1 is an isometric view of a chair including a pair of cushioning and protection apparatuses according to the present invention installed on the chair armrests.
Figure 6:
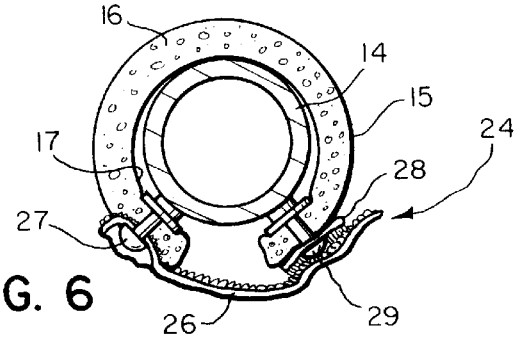
FIG. 6 is a sectional side elevation view of the cushioning and protection apparatus, taken along the line 6—6 of FIG. 1.

FIGS. 1, 2, and 6 show generally a cushioning and protection apparatus 10 for use in connection with a seat or chair 12. The cushioning and protection apparatuses according to the present invention are intended to be installed on armrests 14 of all types of chairs, particularly outdoor chairs, such as patio chairs, lawn chairs, beach chairs, stadium chairs, and the like. The cushioning and protection apparatus 10 generally includes a main cushion body 16 having an exterior facing surface 15 and an interior facing surface 17. The cushion body is preferably made of closed-cell foam, which may further include a skin layer on one or both of the exterior and interior facing surfaces 15, 17.

The cushion body 16 includes opposed ends, a length, and a longitudinal axis. The cushion body is substantially cylindrical in shape and defines a central cavity 18 aligned along the longitudinal axis. The central cavity is preferably sized to receive an armrest of a chair. The central cavity provides a continuous, uninterrupted passageway from one end of the cushion body to the opposite end.

The cushion body further defines a pair of opposed jaw projections 22 which extend from an apex, which has an axis parallel to the longitudinal axis, of the cushion body. The jaw projections 22 form an opening in the form of a slot 20 along one side of the cushion body 16. The jaw projections 22 are resiliently deformable and moldable around a chair armrest. Thus, the armrest can be of any cross-sectional shape. When installing the cushion body 16 onto a chair armrest, the jaw projections 22 are forcibly separated to expand the opening or slot 20. Thereafter, the armrest is inserted through the slot 20 and into the central cavity 18. Typically the foregoing in achieved by aligning the slot 20 with the armrest, forcing open the jaw projections 22, and forcing the cushion body over the armrest so that the cushion body surrounds the armrest. The memory of the resilient material then causes the jaw projections to close and hold the cushion body onto the armrest.

The cushioning body preferably is made of a resilient, formable material such as closed-cell foam. Alternatively, the cushioning body may be made of any other suitable material that can be formed about the armrest to provide protection and cushioning, and that can be secured in place about the armrest by an attachment device. Although the armrest and cushioning apparatus shown in FIGS. 1 and 2 are shown to be cylinder in shape, it is to be understood that the cushioning apparatus could specifically be made to correspond with any cross-sectional shape of armrest. As mentioned above, because of the resiliency of the material, the jaw projections 22 will form around virtually any cross-sectional shape of armrest.

The cushioning and protection apparatus 10 further includes a fastening device in the form of an attachment assembly 24. The attachment assembly preferably comprises a main portion 26 which includes a plurality of loops. The main portion is secured to the cushion body 16 by means of a conventional fastener 27. The attachment assembly also includes a base portion 28 comprising a plurality of hooks. The base portion is secured to the cushion body by means of a conventional fastener 29. The hooks and loops of the base and main portions, respectively, form a releasable attachment devise in the form of a Velcro-type fastener. It is to be understood that other types of fastening devices could be used to maintain the protection and cushioning apparatus in operative position around the armrest.

The cushioning and protection apparatus 10 shown in FIGS. 1 and 2 still further comprises a tether or carrying strap 30 for transporting the device. The carrying strap is attached to one end of the cushioning body 16 by means of a conventional fastener 32. In the embodiment shown in FIG. 2, the carrying strap is in the form of a large loop, which may be used for securing the cushioning and protection device to a person's belt. Because the cushioning apparatus is extremely lightweight, it is easy to carry and use. No special tools, skills, or technical training are required to install or remove the cushioning and protection apparatus on a chair armrest. Most suitably, the cushioning apparatus 10 can be taken to any outdoor event stadium and installed on a chair armrest. The cushioning and protection apparatus will cushion the user's arms and insulate the user's arms from the temperature of the armrest (such as heat from sunlight or cold from low temperatures).

Figure 3:
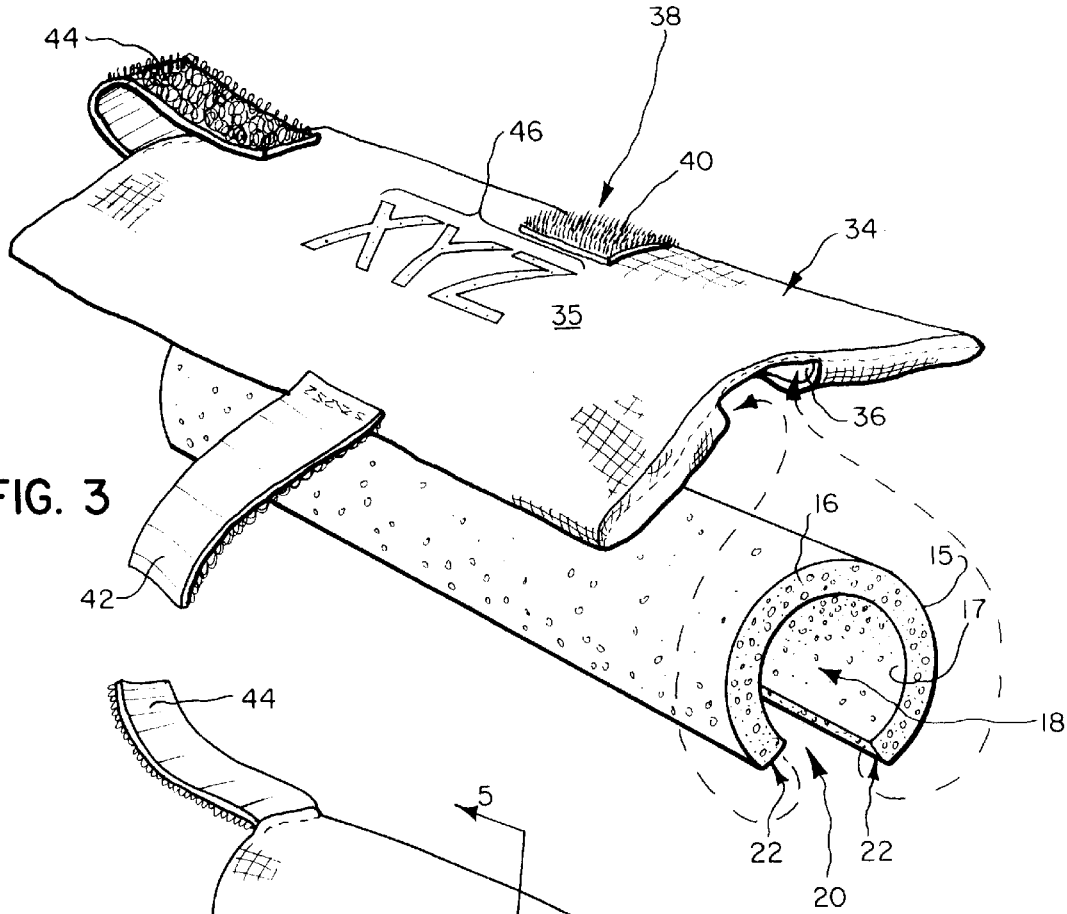
FIG. 3 is an isometric view of an alternative embodiment of a cushioning and protection apparatus for a chair armrest according to the present invention.
Figure 4:
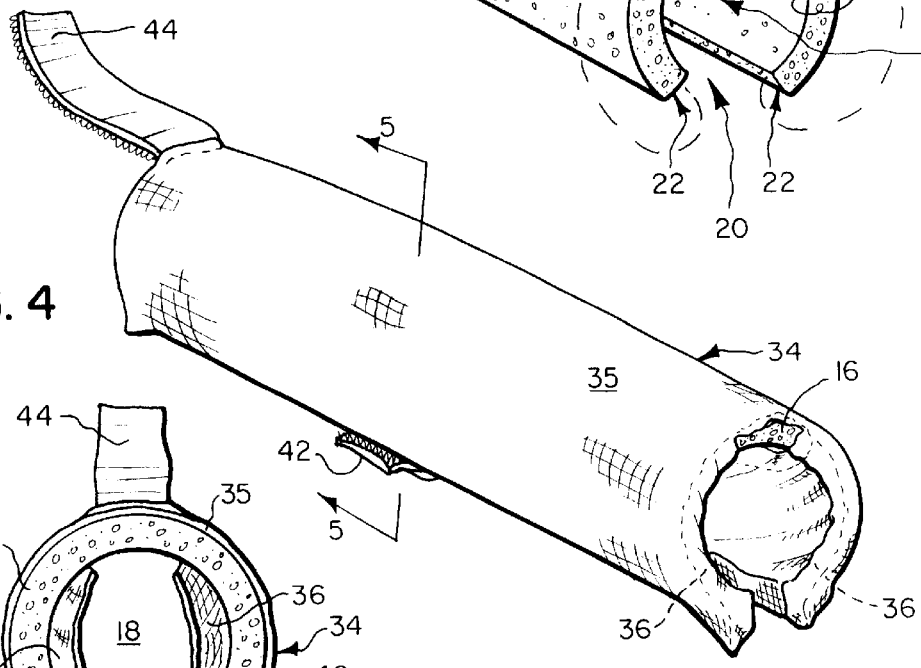
FIG. 4 is an isometric view of the cushioning and protection apparatus of FIG. 3 with a cover installed thereon.
Figure 5:
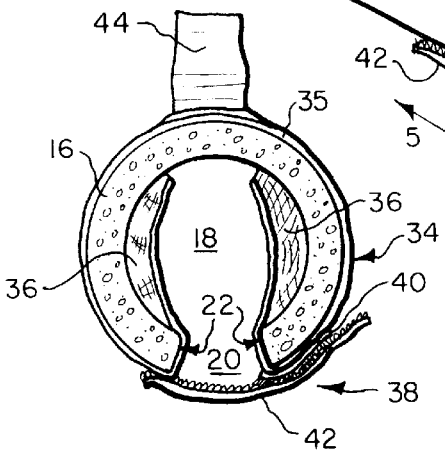
FIG. 5 is a sectional side elevation view of the cushioning and protection apparatus, taken along the line 5—5 of FIG. 4.

FIGS. 3–5 shows an alternative embodiment of the present invention. A main cushion body 16, similar to the cushion body 16 of FIGS. 1, 2, and 6, is shown. Specifically, the cushion body 16 shown in FIGS. 3–5 has the same properties as discussed in connection with the embodiment shown in FIGS. 1 and 2, including a central cavity 18 and a slot 20 formed by jaw projections 22 of the main cushion body 16.

The embodiment of FIGS. 3–5 further comprises a cover 34 disposed over the main cushion body 16. The cover includes a pair of pockets 36 for receiving the jaw projections 22 of the cushion body 16. The concept of using a cover over the cushion body 16 enables a user to install and remove various covers. The covers to be cleaned between uses. In addition, the covers can be advantageously used in marketing or promoting a particular team. Various types of indicia 46 can be placed on the covers. The indicia may comprise, for example, a particular team name, logo, or the like. Further, the cover may be made to suit a particular team color. Although the indicia 46 is shown on the cover 34, it is to be understood that the indicia could similarly be placed directly on the outer surface 15 of the cushion body 16 shown in FIGS. 1, 2, and 6.

Referring still to FIGS. 3–5, an attachment assembly 38 comprising a base portion 40 and a main portion 42 is coupled to the cover 34 to allow the protection and cushioning apparatus to be secured about a chair armrest. The base portion 40 includes a plurality of hooks and for attaching to a plurality of loops on the main portion 42. The base 40 and the attachment strap 42 are secured to the cover by any conventional means, such as by sewing.

The embodiment of FIGS. 3–5 further includes a tether or carrying strap 44 attached to one end of the cover. The carrying strap provides an area by which the entire cover and cushion body can be held and carried with relative ease.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. In combination:

a substantially non-moveable chair having at least one elongated armrest adjacent the waist of a user;

a cushioning apparatus for the chair armrest, comprising:

a hollow foam body having a longitudinal axis, a length, and an exterior facing surface, the foam body being selectively removable from and securable about a chair armrest to cushion and protect an arm of the user;

indicia disposed on the exterior facing surface of the foam body.

2. A combination according to claim 1 wherein the written indicia comprises a team logo.

3. A combination according to claim 1 wherein the written indicia comprises a team name.

4. A combination according to claim 1, wherein the hollow of the foam body comprises a central cavity formed in the foam body along the longitudinal axis of the foam body, the central cavity being sized to enclose at least a portion of the armrest of a chair, the central cavity corresponding to a cross-sectional shape of the armrest.

5. A combination according to claim 1, wherein the hollow of the foam body comprises a longitudinal slit, a cylindrical central cavity formed in the foam body along the longitudinal axis of the foam body, the cylindrical central cavity sized to receive a cylindrical armrest of the chair after the foam body is placed over the armrest at the slit.

6. In combination:

a substantially non-moveable chair comprising a seat and an armrest above the seat;

a cushioning apparatus for the chair armrest, comprising:

a sleeve-shaped foam body having a longitudinal axis and a length, the foam body further comprising an exterior facing surface and an interior facing surface, the foam body being removably securable about an armrest of a chair via a longitudinal slit in the sleeve-shaped foam body to cushion and protect an arm of a user;

a cover secured about the exterior facing surface and disposed within at least some of the interior facing surface of the foam body;

exposed readable indicia disposed on the cover.

7. A combination according to claim 6 wherein the indicia comprises a team logo.

8. A combination according to claim 6 wherein the indicia comprises a team name.

9. A combination according to claim 6, wherein the sleeve-shaped body comprises a central cavity formed in the foam body along the longitudinal axis of the foam body, the central cavity being sized to receive an armrest of a chair, the central cavity being compatible with the cross-sectional shape of the armrest.

10. A combination according to claim 6, wherein the sleeve-shaped foam body a cylindrical central cavity formed in the foam body along the longitudinal axis of the foam body, the cylindrical central cavity intersecting the slit and sized to surround a portion of the armrest of the chair.

11. A combination comprising:

a substantially non-moveable chair comprised of a seat and at least one elongated armrest located above the seat and extending generally in a horizontal direction;

a hollow cushioning arm protector having an elongated sleeve-shaped body with an axial slit along one part of the sleeve-shaped body whereby the protector is flexed in a clam shell fashion to open the slit for removable placement over the elongated armrest above the seat of the chair, the placed protector insulating and isolating the arm of the user from at least one strap fastener bridging the slit after placement of the cushioning arm protector to hold the slit closed and the protector in surrounding relationship with the armrest.

12. A combination according to claim 11 further comprising readable information carried by the protector at an exposed region.

13. A combination according to claim 11 wherein the elongated sleeve-shaped body includes end edges, and further comprising a removable opaque covering enclosing an exterior surface of the protector and extending around the end edges and into the hollow of the protector.

14. A method of simultaneously cushioning and protecting a person's arm and displaying advertising indicia, comprising:

providing an elongated cushion body with a hollow interior, the cushion body including a longitudinal slot and an outside surface;

providing advertising indicia on the outside surface of the cushion body;

providing a substantially non-moveable stadium chair with at least one armrest;

installing the cushion body over the armrest of the substantially non-moveable stadium chair by positioning the armrest into the slot and subsequently into the hollow interior of the cushion body;

displaying the advertising indicia.

15. The method of claim 14 wherein the stadium chair comprises an outdoor stadium chair.

16. The method of claim 14 wherein the outside surface comprises a cover for the cushion body.

17. The method of claim 14 wherein the outside surface comprises a removable cover for the cushion body; and further comprising:

installing a first cover on the cushion body, the first cover having advertising indicia;

removing the first cover from the cushion body; and installing a second cover on the cushion body, the second cover having advertising indicia.

18. The method of claim 14 further comprising installing the cushion body on the armrest of the chair in an outdoor stadium.

19. The method of claim 14 further comprising carrying the cushion body to a stadium for installing on the armrest of the chair.

20. The method of claim 14 wherein providing advertising indicia comprises providing a team logo advertising indicia.

21. The method of claim 14 wherein providing a substantially non-moveable stadium chair comprises providing a permanently mounted stadium chair.

* * * * *